United States Patent [19]

McVeen

[11] 3,972,388

[45] Aug. 3, 1976

[54] LIFT TRUCK MAST ASSEMBLY WITH A RESILIENT CHAIN POSITIONER

[75] Inventor: Milford D. McVeen, Highland Heights, Ohio

[73] Assignee: Towmotor Corporation, Mentor, Ohio

[22] Filed: Aug. 4, 1975

[21] Appl. No.: 601,779

[52] U.S. Cl. ..... 187/9 E

[51] Int. Cl.[2] ..... B66B 9/20

[58] Field of Search ..... 187/9 R, 9 E, 1 R, 95; 214/670–674; 52/115, 121

[56] References Cited

UNITED STATES PATENTS

| | | | |
|---|---|---|---|
| 2,502,465 | 4/1950 | Lehmann | 187/9 E |
| 2,505,009 | 4/1950 | Schroeder | 187/9 E |
| 2,946,406 | 7/1960 | Henry | 187/9 E |

*Primary Examiner*—Jame J. Love
*Assistant Examiner*—James L. Rowland
*Attorney, Agent, or Firm*—J. W. Grant

[57] ABSTRACT

A mast and carriage assembly for a lift truck of the type having a stationary mast section fixed to the truck, a movable inner mast section reciprocable within the stationary mast, a fork carriage movably associated with the inner mast section, a hydraulic jack having an extensible and retractable rod, means operatively connected to the rod for moving the inner mast section relative to the stationary mast section and having a sheave rotatably mounted thereon, a flexible chain trained over the sheave and having one end attached to the carriage, and an elongated chain rod having one end attached to the other end of the chain and its other end loosely fastened to the stationary mast, with the improvement including a bracket attached to the hydraulic jack adjacent its upper end and a resilient link having one end fastened to the bracket and its other end fastened to the chain rod for normally positioning the end of the chain rod relative to the lift jack while permitting limited relative movement therebetween.

6 Claims, 3 Drawing Figures

42
44
29
27
14
18
26
43
46
27
10
III
III
54
52
11
13
48
41
36
17
16
47
27
36
21
34
37
51
18
23
51
24
49
19
22

LIFT TRUCK MAST ASSEMBLY WITH A RESILIENT CHAIN POSITIONER

BACKGROUND OF THE INVENTION

Fork lift trucks commonly have a vertically extendable mast assembly wherein a fork carriage is movable relative to an inner mast section which is in turn reciprocably mounted within an outer mast assembly. The fork carriage is raised by a hydraulic jack through a chain and pulley arrangement while the inner mast section is raised directly by the hydraulic jack. To reduce the length of the chain, some of the mast assemblies include an elongated chain rod having one end pivotally attached to the chain and its other end anchored to the stationary mast section. The hydraulic jack and chain rod are normally loosely mounted within the mast assembly to permit a slight degree of freedom to accommodate for the looseness in the mast assembly as well as any deformation occurring in the mast assembly when supporting a load. One of the problems frequently encountered with such an arrangement occurs when the fork carriage is being lowered to place a load on an elevated loading dock, tote tub, and the like. If the hydraulic jack is allowed to retract after movement of the fork carriage is stopped in a elevated position, the inner mast section will continue to move downwardly and the lift chain becomes slack. Occasionally, the chain and chain rod will buckle toward the truck and become entrapped beneath a cross brace of the downwardly moving inner mast section. This causes binding and malfunctioning of the mast assembly and leads to failure in the chain mechanism.

Objects of the Invention

Accordingly, an object of this invention is to provide an improved lift truck mast assembly with a resilient chain positioner.

Another object of this invention is to provide an improved lift mast assembly with a resilient chain positioner which prevents interference between the chain and mast sections during lowering of the fork carriage while permitting limited restrained movement therebetween.

Other objects and advantages of the present invention will become more readily apparent upon reference to the accompanying drawings and following description.

DESCRIPTION OF THE PREFERRED EMBODIMENT

Figure 1:
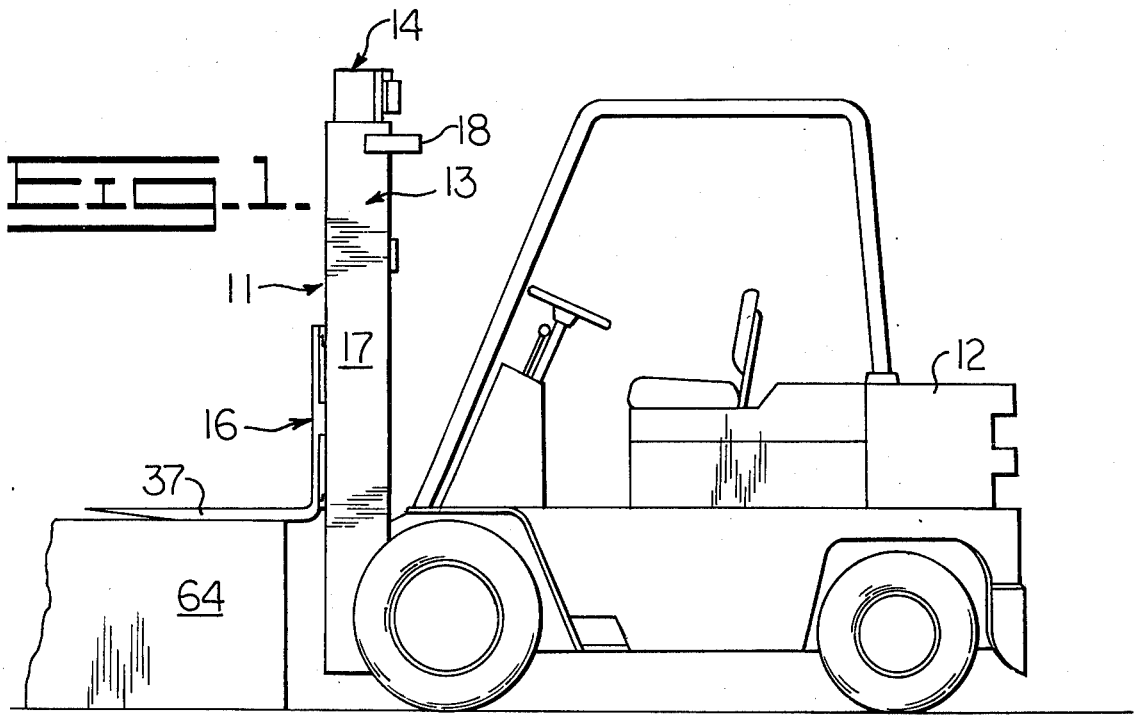
FIG. 1 is a side elevational view of a fork lift truck having a lift mast assembly mounted to its forward end.
Figure 3:
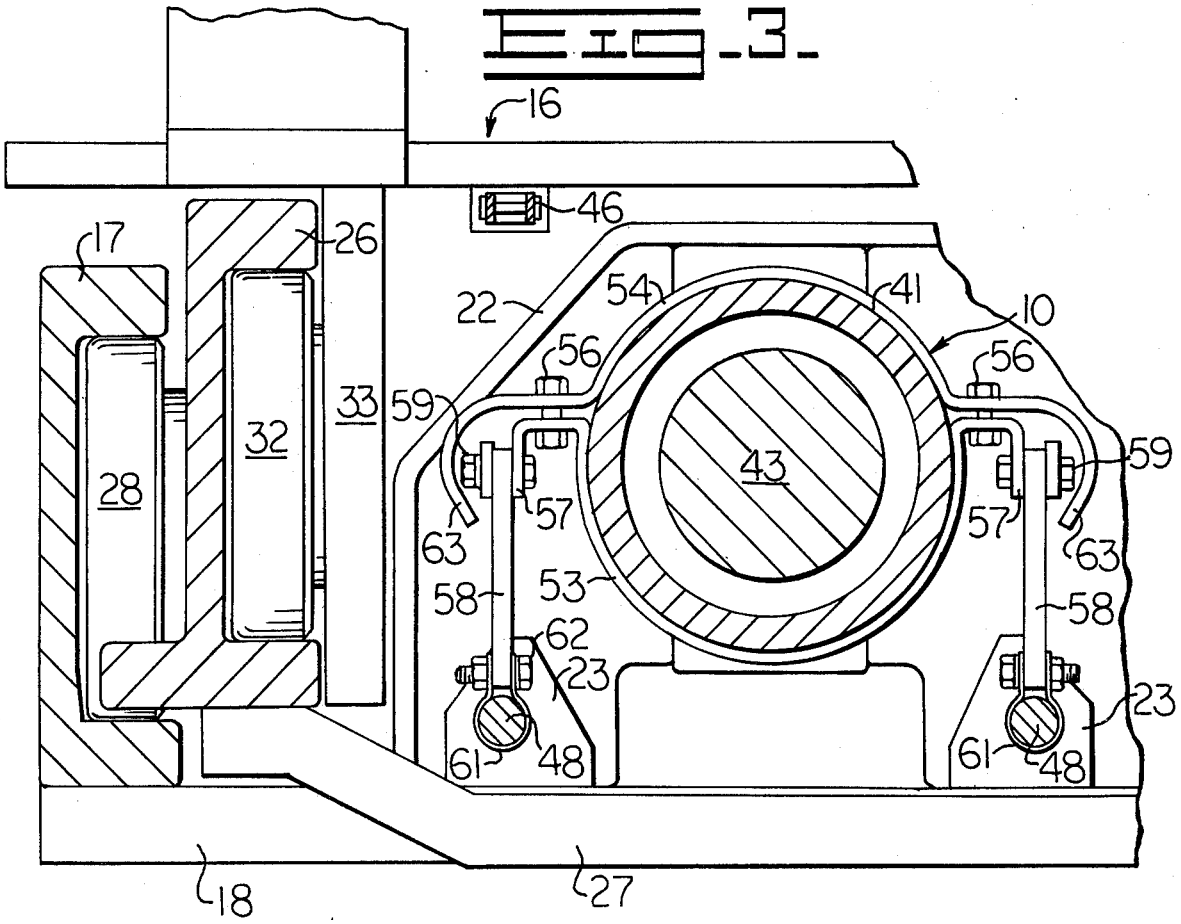
FIG. 3 is a cross sectional view taken along line III—III of FIG. 2.
Figure 2:
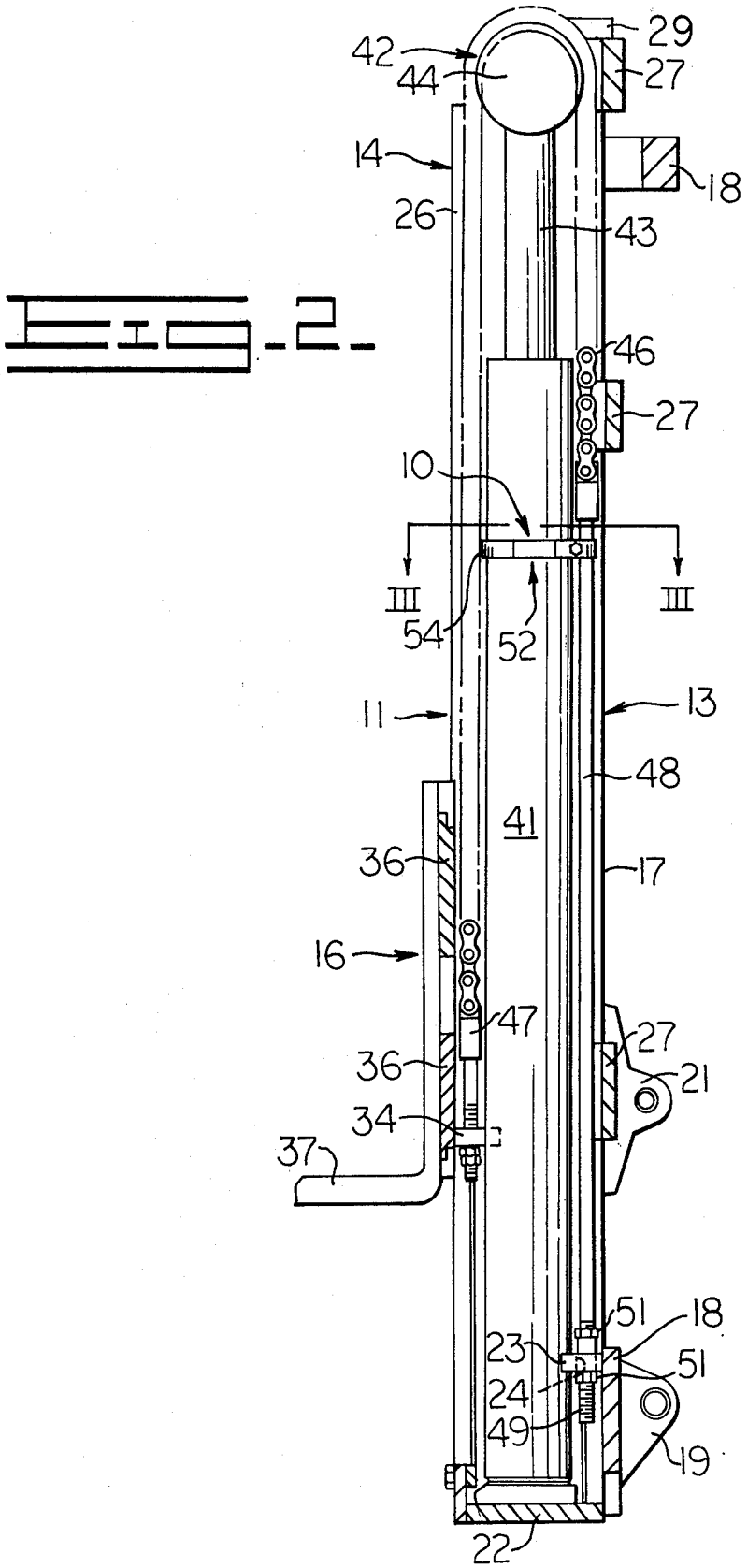
FIG. 2 is a vertical sectional view through the lift mast assembly of FIG. 1 and illustrating a resilient chain positioner embodying the principles of the present invention.

Referring now to the drawings, and more particularly to FIGS. 2 and 3, a lift truck mast assembly with a resilient chain positioner embodying the principles of the present invention is generally indicated by the reference numeral 10 in association with a mast assembly 11 of a fork lift truck 12. The mast assembly is similar in construction to that described in the U.S. Pat. No. 3,851,732 assigned to the assignee of the present application and which is incorporated by reference herein. The mast assembly includes a stationary mast section 13 suitably fastened to the forward end of the lift truck, a movable inner mast section reciprocable within the stationary mast section, and a fork carriage 16 slidably associated with the inner mast section.

The stationary mast section 13 includes a pair of upright laterally spaced parallel channel members, one of which is shown at 17. The channel members are rigidly connected together by a plurality of cross braces 18 with the channels open toward each other. A pair of mounting brackets, one shown at 19, are secured to the rearward sides of the lower cross brace, while another pair of mounting brackets, one shown at 21 are individually attached to the rearward sides of the channels above the lower cross brace. The mounting brackets are employed for pivotally attaching the mast assembly to the truck in the usual manner. A jack support structure 22 is secured to the lower cross brace and extends forwardly therefrom. A pair of forwardly extending lugs 23 are secured to the lower cross brace with each lug having a vertically oriented bore 24 extending therethrough.

The inner mast section 14 is reciprocably mounted within the stationary mast section in the usual manner and includes a pair of laterally spaced parallel J-shaped channel members, one of which is shown at 26 in FIG. 3. The channel members are disposed inwardly from the channel members 17 and are rigidly interconnected by a plurality of cross braces 27 with the channels open toward each other. A plurality of rollers, one shown at 28, are provided to permit the inner mast section to move vertically relative to the stationary mast section. A tab, partially shown at 29 in FIG. 2 extends forwardly from the upper cross brace intermediate the channel members.

The fork carriage 16 is reciprocably mounted relative to the inner mast section 14 in the usual manner and includes a plurality of rollers, one shown at 32 in FIG. 3, rotatably attached to a vertical member 33 and disposed within the channel members 26. A lug 34 extends rearwardly from a lower cross plate 36. A pair of L-shaped forks, one shown at 37, are mounted on an upper cross plate 38.

A vertically oriented hydraulic lift jack 41 has its lower end supported by the lift jack support structure 22 of the stationary mast section 13. A cross head 42 is secured to an extensible and retractable piston rod 43 and rotatably carries a pair of sheaves, one shown at 44, which sheaves being disposed on opposite sides of the piston rod. Each of a pair of chains 46 is trained over its respective sheave and has one end fastened to a coupling link 47 which is fastened to the rearwardly extending lug 34 of the fork carriage 16. The other end of the chain is connected to an elongated chain rod 48 which has a lower threaded end 49 extending through the bore 24 of the forwardly extending lug 23 of the stationary mast section 13. The threaded end is adjustably loosely attached to the lug by a pair of nuts 51. Both the lift jack and the chain rods are loosely connected to the respective mountings to permit limited movement of the upper ends of the lift jack and chain rod to compensate for looseness and distortion between the inner mast section and the stationary mast section.

A resilient chain positioner 52 is provided to resiliently position the upper ends of the chain rods 48 relative to the lift jack 41. The positioner includes a bracket in the form of a pair of C-shaped clamp members 53 and 54 which encircle the upper end of the lift jack 41 and are secured thereto by bolting the members together with a pair of bolts 56. Each end of the member 53 forms a rearwardly extending ear 57. Each of a pair of rubber resilient links 58 has one of its ends secured to a respective one of the ears with a bolt 59. A clamp 61 encircles the upper end of the chain rod and is secured to the other end of the resilient links by a bolt 62. Ends 63 of the member 54 extend rearwardly individually forming a C-shaped enclosure around the ears and the connection between the ears and the resilient link with the ends being disposed adjacent to the links.

Operation

While the operation of the present invention is believed clearly apparent from the foregoing description, further amplification will subsequently be made in the following brief summary of such operation. For raising the fork carriage 16 hydraulic fluid from a suitable source is directed to the lift jack 41 for extending the piston rod 43. Extending the piston rod moves the cross head 42 and the sheaves 44 upwardly. With one end of each chain anchored to the stationary mast section through the chain rod 48, the initial upward movement of the sheaves causes the fork carriage 16 to move upwardly. The cross head subsequently engages the tab 29 of the inner mast section 14 and moves the inner mast section upwardly at approximately one-half the vertical speed of the fork carriage.

Lowering the fork carriage 16 from an elevated position is achieved by exhausting the fluid from the lift jack 41 permitting the fork carriage and inner mast section 14 to move downwardly under the influence of their own weight and thereby moving the piston rod 43 and related elements downwardly. Should the fork carriage be stopped in an elevated position such as would occur when the forks 37 engage a loading dock or the like indicated at 64, the inner mast section will continue to move downwardly unless the outflow of fluid from the lift jack is stopped. When the inner mast section moves downwardly with the fork carriage stopped, the chain 46 will become slack. However, the resilient chain positioner 52 will maintain the upper end of the chain rod 48 in its position relative to the lift jack and will prevent the chain rod and chain from flopping rearwardly beneath the cross braces 27. Upon inspection of FIG. 2, it will be apparent that without the resilient positioner of the present invention, the upper end of the chain rod could flop rearwardly beneath the intermediate cross brace 27 should the chain become slack as previously described particularly if the upper end of the mast assembly is tilted rearwardly toward the lift truck in a normal load carrying position.

In view of the foregoing, it is readily apparent that the structure of the present invention provides an improved resilient chain positioner for preventing interference between the chain and the lift mast structure while permitting limited restrained movement thereof to compensate for looseness normally associated with a lift mast assembly.

While the invention has been described and shown with particular reference to the preferred embodiment, it will be apparent that variations might be possible that would fall within the scope of the present invention which is not intended to be limited except as defined in the following claims.

What is claimed is:

1. In a mast and carriage assembly for a lift truck of the type having a stationary mast section fixed to the truck, a movable inner mast section reciprocable within the stationary mast, a fork carriage movably associated with the inner mast section, a hydraulic jack having an extensible and retractable rod, means operatively connected to the rod for moving the inner mast section relative to the stationary mast section and having a sheave rotatably mounted thereon, a flexible chain trained over the sheave and having one end attached to the fork carriage, and an elongated chain rod having one end attached to the other end of the chain and its other end loosely anchored to the stationary mast wherein the improvement comprises;

a bracket attached to the hydraulic jack at its upper end; and a resilient link having one end fastened to the bracket and its other end fastened to the chain rod for normally positioning the end of the chain rod relative to the jack while permitting restrained limited relative movement therebetween.

2. The mast and carriage assembly of claim 1 wherein said bracket includes a pair of C-shaped members clamped around the hydraulic jack.

3. The mast and carriage assembly of claim 2 wherein said resilient link is rubber and including a clamp member encircling the chain rod and fastened to the other end of the resilient link.

4. The mast and carriage assembly of claim 3 wherein said hydraulic jack is supported by the stationary mast section, said inner mast section moving means is a crosshead, and including another sheave rotatably mounted to the crosshead, another flexible chain trained over said other sheave and having one end attached to the fork carriage, another elongated chain rod having one end attached to the other end of the other chain and its other end loosely anchored to the stationary mast, and another resilient link having one end fastened to the bracket and its other end fastened to the other chain rod.

5. The mast and carriage assembly of claim 4 wherein the ends of one of said C-shaped members forms a pair of ears extending toward the chain rod, and including a pair of fasteners individually fastening said resilient links to the ears.

6. The mast and carriage assembly of claim 5 wherein the ends of the other C-shaped member form a pair of C-shaped enclosures around the ears and fasteners with the ends disposed adjacent to the resilient links.

* * * * *